United States Patent [19]

Shinozaki et al.

[11] 4,218,124

[45] Aug. 19, 1980

[54] PHOTO-SENSITIVE SCREEN FOR PRODUCING ELECTROSTATIC LATENT IMAGE

[75] Inventors: Sohji Shinozaki; Yoshiaki Takei; Haruo Iwahashi, all of Hachioji, Japan

[73] Assignee: Konishiroku Photo Industry Co., Ltd., Tokyo, Japan

[21] Appl. No.: 960,835

[22] Filed: Nov. 15, 1978

[30] Foreign Application Priority Data

Nov. 22, 1977 [JP] Japan ..... 52-140115

[51] Int. Cl.[2] ..... G03G 15/00

[52] U.S. Cl. ..... 355/3 SC; 430/31; 430/68

[58] Field of Search ..... 355/3 R, 3 SC; 339/17 T; 430/31, 68, 135

[56] References Cited

U.S. PATENT DOCUMENTS

| | | | |
|---|---|---|---|
| 2,791,723 | 5/1957 | Nagy et al. | 339/17 T X |
| 2,982,934 | 5/1961 | Browne | 339/17 T X |
| 3,005,170 | 10/1961 | Starr | 339/17 T X |
| 3,713,734 | 1/1973 | Crane et al. | 355/3 SC |

*Primary Examiner*—Fred L. Braun

*Attorney, Agent, or Firm*—Bierman & Bierman

[57] ABSTRACT

A photo-sensitive screen for producing an electrostatic latent image of an original to be copied is of multi-layer structure having an apertured region in which fine apertures are formed in uniform distribution and including a photo-conductive insulative layer, an electrically conductive substrate, an insulating layer and an electrically conductive layer superposed upon one another in this order, wherein a solid region having no apertures is formed outside of the apertured region for allowing an electrode to be secured thereon in electrical contact with the electrically conductive layer. The electrode serves for applying a bias voltage to the electrically conductive layer for establishing electric field of a predetermined profile between the conductive substrate and the conductive layer across the interposed insulating layer.

12 Claims, 5 Drawing Figures

PHOTO-SENSITIVE SCREEN FOR PRODUCING ELECTROSTATIC LATENT IMAGE

BACKGROUND OF THE INVENTION

1. Field of the Invention

The present invention relates to a photo-sensitive image screen provided with an electrode for applying a bias voltage, which screen is adapted for producing an electrostatic latent image of an original to be copied and regulating charged particles which pass through the screen in accordance with the latent image in copying operation.

2. Description of the Prior Art

The photo-sensitive screen of multi-layer structure of the above-mentioned type has been already known, as is disclosed in U.S. Pat. No. 3,713,734, for example. Referring to FIG. 1 of the accompanying drawings which shows schematically and fragmentally a section of a hitherto known photo-sensitive image screen, it is composed of an electrically conductive substrate 2 having fine apertures 1 formed in a uniform distribution over the whole area thereof, an insulating layer 3 formed on one surface of the substrate 2, an electrically conductive layer 4 formed over the insulating layer 3 and adapted to be applied with a bias voltage, and a photo-conductive insulating layer 5 formed on the other surface of the substrate 2.

The photo-sensitive image screen of the structure described above is used for producing an electostatic latent image of an original to be copied in a manner described below.

In the first place, the photo-sensitive screen is subjected to a primary corona discharge in a dark place, whereby the photo-conductive insulation layer 5 is electrically charged uniformly. Subsequently, the image of the original to be copied is exposed to the photo-conductive insulation layer 5 and is electrically charged uniformly. Subsequently, the image of the original to be copied is exposed to the photo-conductive insulation layer 5 thereby to form a primary electrostatic latent image of the original. Next, an insulative recording material such as paper is juxtaposed adjacent to the photo-conductive insulation layer 5 with a very small gap being maintained therebetween. In this state, a secondary discharge is effected from the opposite side i.e. from the electrically conductive layer 4, whereby charged particle beams are projected to the recording material through the apertured photo-sensitive screen. When a bias voltage is applied to the electrically conductive layer 4, there will be produced electric fields in the apertures 1 which have intensities different from one another in dependence on the quantity of electric charge stored in the peripheral portions of the respective apertures in correspondence to the primary electrostatic latent image. These electric fields will serve then as accelerating or suppressing field for the charged particle beams passing through the apertures 1. As the result, the insulative recording material is subjected to the exposure of the charged particle beams having intensities corresponding to the primary electrostatic latent image, resulting in production of a secondary electrostatic latent image corresponding to the original image on the recording material. The secondary latent image thus obtained can be visualized through appropriate dry-or wet-type developing process. In this connection, it will be noted that the secondary electrostatic latent image corresponding to the negative or dia-positive of the original image can be produced with a desired polarity of electric charge by correspondingly selecting the polarity and intensity of the charged particle beam and/or the polarity and magnitude of the biasing voltage.

Heretofore, the substrate 2 of the photo-sensitive screen has been constituted by a net of fine mesh woven of fine wires having a diameter on the order of 20 to 80 microns, which wire is made of a metal such as iron, nickel, chromium, copper, zinc, aluminium or the like or an alloy such as stainless steel, brass or the like. Alternatively, the substrate 2 can be implemented as a plated mesh of 20 to 100 microns thick formed by electrolytic deposition from an aqueous solution containing salts of metals described above through a well known electroforming process. Further, the substrate 2 may be formed through a photo-etching technique in which a plate of metal or alloy described above and having a thickness on the order of 20 microns to 100 microns is formed with the fine apertures over the whole surface thereof. The density of the mesh lines of the substrate 2 will vary in dependence on the resolving power, tone graduation or the like factors. However, the line density is usually selected in the range of 50 to 300 lines/inch.

The insulating layer 3 formed on the one surface of the substrate 2 is usually made of an electrically insulating material exhibiting a high electric resistance. For example, synthetic resins such as silicone resin, alkyd resin, epoxy resin, polyester resin, acrylic resin, vinyl resin or the like may be used. The insulating layer 3 may be formed by applying resin material solved in a suitable solvent through spraying or application by a brush on the conductive substrate 2 in such manner that the apertures remain opened. Alternatively, the insulating layer 3 may be formed of an organic compound such as polyparaxylene or an inorganic compound such as silicon dioxide or the like through vacuum evaporation. The thickness of the insulating layer 3 will vary in dependence on the physical properties of the material as used and practically lies in the range of 5 to 100 microns.

The electrically conductive layer 4 for applying the bias voltage may be formed of a metal such as gold, silver, aluminum, nickel or the like through vacuum evaporation or alternatively formed of an electrically conductive paint containing finely pulverized powder of the metal described above dispersed in a resin adhesive through brushing or spraying application, while preventing invasion of the paint material into the apertures 1. The thickness of the conductive layer is usually on the order of less than 1 micron.

As hereinbefore described, the essential function of the conductive layer 4 is to produce electric fields in the apertures 1 for accelerating or blocking the charged particles which pass through the photo-sensitive screen and to the recording material. To this end, the conductive layer 4 has to be applied with the bias potential uniformly over the whole area thereof. The application of such bias voltage may be realized through a lead wire conductor connected to an end of the conductive layer 4 after the formation thereof by using a heat-fusible solder alloy or an electrically conductive adhesive paint. It has been however found that the connection of the lead wire through soldering under heat is accompanied with drawbacks. For example, because of the conductive layer being very thin it is difficult to obtain a satisfactory adhesion or bond. Besides, there may arise destruction of the insulating layer as well as flow of the fused solder material into the adjacent apertures 1. On the other hand, in the case of using electrically conductive paint, poor adhesion or bonding will often result due to the fact that the conductive layer itself is of mesh structure, although the destruction of the insulating layer can be prevented. Further, the liquid paint will be likely to flow in the apertures 1 formed in the substrate 2, possibly involving formation of short-circuits to the substrate. The bonding of the lead wire with the electrically conductive paint is thus impractical. It is also conceivable that the electrode or contact for applying the bias voltage to the electrically conductive layer is constituted by an electrically conductive leaf spring secured to a frame for supporting the photo-sensitive screen in the tensioned state instead of securing directly the lead wire to the electrically conductive layer 4. For example, a resilient plate of phosphoric bronze fixedly mounted on the frame is brought into contact with the electrically conductive layer 4 under pressure to be used as the electrode for applying the bias voltage thereto. However, in this case, there may arise the possibility of an unsatisfactory electrical contact between the terminal electrode and the electrically conductive layer 4 as well as physical destruction thereof due to friction between the contacting surfaces.

SUMMARY OF THE INVENTION

Accordingly, an object of the present invention is to provide a photo-sensitive image screen provided with an electrode for applying a bias voltage which is free from the drawbacks of the hitherto known screen described above.

The above and other objects, novel features and advantages of the invention will become more apparent from detailed description of the preferred embodiments thereof taken in conjunction with the accompanying drawings.

DETAILED DESCRIPTION OF THE PREFERRED EMBODIMENTS

Figure 1:
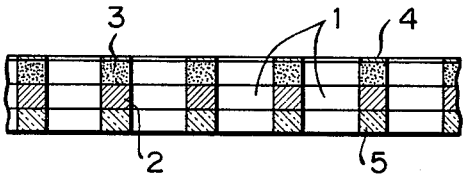
FIG. 1 Prior Art
FIG. 1 is a schematic fragmental sectional view showing a fundamental structure of a hitherto known photo-sensitive screen for producing an electro-static latent image of an original to be transferred to a recording material.
Figure 2:
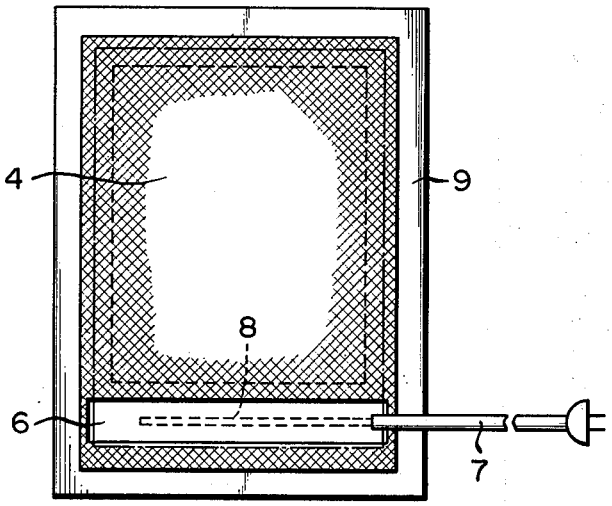
FIG. 2 is a top plan view showing a photo-sensitive image screen according to an embodiment of the invention.

Now, the invention will be described in connection with the exemplary embodiments thereof shown in the drawings. Referring to FIG. 2 the photo-sensitive screen which may be of the similar construction as the one shown in FIG. 1 is fixedly held in a tensioned state by a supporting frame 9 and has a solid region 6 having no apertures adjacent to the latent image producing area shown as enclosed by a broken line block. Core wire conductor 8 of a lead conductor 7 for supplying the bias voltage to the photosensitive screen is secured to the screen at the solid region 6. The electrically conductive layer 4 is formed so as to include the solid region 6 having the lead wire 8 secured thereto (refer to the area defined by a dotted broken line). It is preferred that the electrically conductive layer 4 is located within the supporting frame 9 with a small peripheral gap relative thereto with a view to preventing a short-circuit from being formed between the layer 4 and the frame 9. The solid region 6 having no apertures such as those shown in FIG. 1 may be realized in various manners described below.

Figure 3:
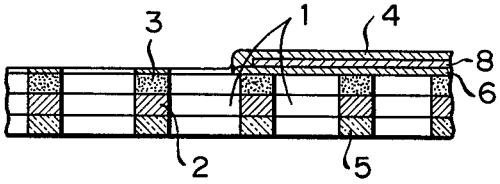
FIG. 3 is a fragmental sectional view of a photo-sensitive screen having an electrode for bias voltage application provided according to an embodiment of the invention.

According to a first method, the solid region 6 is formed after the insulating layer 3 having been formed on the electrically conductive substrate 2, as is shown in FIG. 3. For implementing the solid region 6, a tape having one surface applied with an adhesive or bonding material such as Myler tape, Teflon tape, vinyl tape, cellophane tape, paper tape, metal foil tape or the like is bonded to the insulating layer 3 at the solid region 6 after having been cut in desired width and legth. In the case of the tape having no adhesive layer applied previously, a bonding material of epoxy series or rubber series may be employed to bond the cut tape for forming the solid region 6. Alternatively, it is also possible to form the solid region only by applying the bonding material of the epoxy series onto the insulating layer 3 at the corresponding portion thereof. However, there may arise difficulty in forming a smooth thin layer. In the case of the tape material which is likely to undergo remarkable variations in dimension under the influence of ambient temperature and humidity, a thin resin film (not shown) of a material scarcely susceptible to the temperature and humidity may be formed all over the surface of the bonded tape inclusive of the surrounding region of the insulating layer 3 thereby to protect the tape from any deformation due to the temperature and humidity.

Figure 4:
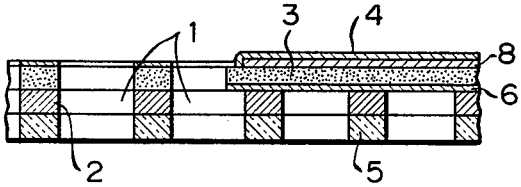
FIG. 4 is a view similar to FIG. 3 and shows another embodiment of the invention.

Another method for forming the solid region 6 is illustrated in FIG. 4.

According to this method, the solid region 6 is formed directly over the substrate 2 with the insulating layer 3 being formed subsequently over the solid region 6 in the substantially same manner as in the case of structure shown in FIG. 3. The embodiment shown in FIG. 4 brings about an advantage that the solid layer 6 is scarcely subjected to influence of temperature and humidity independently from the material thereof by virtue of the fact that the solid region or layer 6 is protected by the overlying insulating layer 3, whereby the use of the additional protecting layer as is in the case of the structure shown in FIG. 3 is not required.

Figure 5:
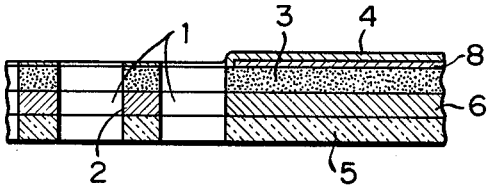
FIG. 5 is a view similar to FIG. 3 and shows still another embodiment of the invention.

FIG. 5 illustrates still another method of forming the solid region 6 according to which the region 6 is implemented in the substrate 2 itself. This structure is particularly suitable for the conductive substrate 2 which is formed through the photo-etching process described hereinbefore. Then, the solid region 6 can be formed simultaneously and integrally with the region formed with the apertures. Further, in the case of the substrate constituted by the woven net or mesh, the solid region 6 can be realized by the insulating layer 3 itself without resorting to the use of additional material such as the tape described above, thus involving no increase in the thickness of the solid region 6.

When the solid region 6 has been formed according to any one of the methods described above, then the lead wire 8 for applying the bias voltage as well as the biasing conductive layer 4 can be formed. It will be appreciated that the lead conductor 7 is connected and secured to the screen at the solid region 6. To this end, the wire 8 of the lead conductor 7 is fixedly secured to the region 6 at a center portion and an electrically conductive paint is applied thereover, thereby to assure electrical connection between the lead conductor 7 and the solid region 6. In order to prevent short-circuit from being formed externally of the solid region 6, the lead conductor for applying the bias voltage should be coated with an electrically insulating material except for the portion lying in the solid region 6.

Subsequently, the biasing conductive layer 4 is formed over the insulating layer 3 inclusive of the wire 8 of the lead conductor 7 for applying the bias voltage. For the material of the conductive layer 4, a metal such as gold, silver, copper, aluminium, nickel or the like may be used, as described hereinbefore.

Finally, the photo-conductive insulative layer 5 is formed of selenium, selenium-telluriem alloy, selenium-arsenic alloy or the like through vacuum evaporation process. Alternatively, the layer 5 may be formed by applying or spraying a liquid composition containing a bonding or adhesive material dispersed with fine particles of electrophoto-conductive material such as zinc oxide, cadmium sulfide or the like.

As will be appreciated from the foregoing description, the present invention has provided an improved structure for applying the bias voltage to the biasing conductive layer of the photo-sensitive image screen without failure and possibility of forming a short-circuit to the conductive substrate in a simplified construction to allow the photo-sensitive screen to be manufactured at low costs. Although the invention has been described in conjunction with the preferred embodiments shown in the drawings, it will be appreciated that the invention is never restricted to these embodiments but many and various modifications may occur to those skilled in the art without departing from the spirit and scope of the invention.

We claim:

1. A photo-sensitive screen for producing an electrostatic latent image within an apertured region in which a plurality of fine apertures are formed with a uniform distribution from a multi-layer structure, said structure comprising a photo-conductive insulative layer, an electrically conductive substrate, a second insulating layer and an electrically conductive layer superimposed in that order, in combination with means forming a solid nonapertured area of insulating material on said screen outside of the active apertured region thereof, and a lead conductor connected to said electrically conductive layer within said nonapertured area, whereby upon application of a bias voltage to said conductive layer through said lead conductor, an electric field of a predetermined profile is formed between said conductive layer and said conductive substrate separated by said interposed second insulating layer.

2. A photo-sensitive screen according to claim 1, in which the means forming said solid nonapertured area comprises insulating bonding tape.

3. A photo-sensitive screen according to claim 1, in which the means forming said solid nonapertured layer is positioned between said second insulating layer and said electrically conductive layer.

4. A photo-sensitive screen according to claim 3, in combination with an electrically conductive paint covering said lead conductor and attaching the same to the means forming said solid nonapertured layer.

5. A photo-sensitive screen according to claim 1, in which the means forming said solid nonapertured layer is positioned between said electrically conductive substrate and said second insulating layer.

6. A photo-sensitive screen according to claim 1, in which the means forming said solid nonapertured layer is formed integrally with and replaces said electrically conductive substrate outside of the active apertured region of the screen, and intermediate said photo-conductive insulating layer and said second insulating layer.

7. A method of making a photo-sensitive screen having an active area for producing an electrostatic image which includes the steps of forming a uniformly finely apertured electrically conductive substrate, forming a first insulating layer on one side of said substrate, forming a conductive layer over the insulating layer, forming a photo-conductive insulating layer on the other side of the electrically conductive substrate, forming a region on said screen outside of the active area thereof with a solid nonapertured layer of insulating material, and connecting a lead conductor to said conductive layer within the region covered by said solid nonapertured layer of insulating material, said conductive layer being formed both on said insulating layer and over said lead conductor.

8. The method according to claim 7, in which said solid nonapertured layer is formed over said first insulating layer.

9. The method according to claim 8, in which said insulating material is bonding tape.

10. The method according to claim 9, which includes the further step of applying a temperature and humidity-stable thin resin film over said bonding tape.

11. The method according to claim 7, in which said solid nonapertured layer is formed over said electrically conductive substrate prior to the forming of said first insulating layer.

12. The method according to claim 7, in which said solid nonapertured layer is formed substantially simultaneously and coplanar with the formation of said electrically conductive substrate.

* * * * *